US006026532A

United States Patent [19]

Catanzaro

[11] Patent Number: 6,026,532

[45] **Date of Patent: *Feb. 22, 2000**

[54] TOOTHBRUSH ASSEMBLY

[76] Inventor: David Catanzaro, 626 Penn Ave., Mayfield, Pa. 18433

[ * ] Notice: This patent issued on a continued prosecution application filed under 37 CFR 1.53(d), and is subject to the twenty year patent term provisions of 35 U.S.C. 154(a)(2).

[21] Appl. No.: 08/777,032

[22] Filed: Dec. 30, 1996

Related U.S. Application Data

[60] Provisional application No. 60/009,323, Dec. 28, 1995.

[51] Int. Cl.[7] ..... A46B 9/04

[52] U.S. Cl. ..... 15/167.1; 15/184; 15/143.1; 15/257.01; D4/108; D4/107; D6/534; 248/111; 132/308

[58] Field of Search ..... D4/104, 107, 108, D4/125, 126; D6/528, 534; 15/167.1, 143.1, 184, 257.01, 146, 246; 248/110, 111; 132/308, 309; 206/362.3, 349, 457

[56] References Cited

U.S. PATENT DOCUMENTS

| | | | |
|---|---|---|---|
| D. 144,275 | 3/1946 | Vandeventer | D4/107 |
| D. 155,668 | 10/1949 | Zandberg et al. | D4/107 |
| D. 197,309 | 1/1964 | Feuerbacher | D4/107 |
| D. 279,248 | 6/1985 | Oliver | D6/534 |
| D. 388,254 | 12/1997 | Schiffer | D4/107 |
| D. 389,314 | 1/1998 | Schiffer | D4/107 |
| D. 392,464 | 3/1998 | Jesiolowski | D4/107 |
| D. 395,757 | 7/1998 | Schiffer | D4/107 |
| 1,342,521 | 6/1920 | Yanagihara | 15/167.1 |
| 3,138,813 | 6/1964 | Kaplan | 15/22 |
| 5,590,436 | 1/1997 | Wright et al. | 15/167.1 |
| 5,675,859 | 10/1997 | Barre | 15/167.1 |

*Primary Examiner*—Gary K. Graham

[57] ABSTRACT

A toothbrush assembly comprising a toothbrush having a first and second end, and a bristle head being positioned on the first side of the first end. A stand in the shape of a pair of feet retains the brush in a vertical position when the stand is placed on a horizontal surface. For additional support, a base may be incorporated with the stand. In preferred form, the handle is in the shape of an animate object conforming with the shape of the foot stand. A cover is provided having the shape of a head conforming with the shape of the handle and foot stand, for selectively covering the bristle head.

14 Claims, 3 Drawing Sheets

TOOTHBRUSH ASSEMBLY

This application claims the benefit of U.S. provisional Application No. 60/009,323, filed Dec. 28, 1995.

BACKGROUND OF THE INVENTION

1. Field of the Invention

The instant invention relates generally to toothbrushes, and more specifically it relates to a toothbrush assembly which may contain a combination of appealing qualities to a child, and thereby may promote a superior way to achieve desirable habits associated with good oral hygiene.

2. Description of the Prior Art

There are various advantages in storing a toothbrush in an upright position, and numerous patents have disclosed holders or stands for retaining a toothbrush in a vertical position when placed on a horizontal surface. For instance, U.S. Pat. No. 5,444,889 (Barre) discloses a toothbrush assembly including a toothbrush and a stand for holding the brush. The stand includes a cup portion having a cavity within, wherein the brush handle can be inserted. A pair of legs separate and unattached to one another support and are connected to the cup portion. Further included is a foot for each leg, each foot being connected to the lower end of the leg opposite the cup portion. The feet are also separate and unattached from one another. U.S. Pat. Des. No. 369,932 and U.S. Pat. Des. No. 370,147 (Petronio) discloses a toothbrush holder in the shape of a torso having a front and rear portion. The front portion includes a recess extending therethrough, wherein a brush handle can be inserted. Further included, extending from the front portion, is a pair of feet which are separate and unattached from one another. A tail section extends from the rear portion. While these units may be suitable for the particular purpose to which they address, they would not be suitable for the purposes of the present invention as heretofore described.

SUMMARY OF THE INVENTION

A first object of the present invention is to provide a toothbrush assembly that will overcome the shortcomings of the prior art devices.

A second object is to provide a toothbrush assembly, comprising a toothbrush having a first and second end, and a bristle head being positioned on the first side of the first end, and a stand for retaining the brush in a vertical position when the stand is placed on a horizontal surface.

A third object is to provide a toothbrush assembly, in which the stand is releasably connected to the toothbrush handle.

A forth object is to provide a toothbrush assembly, in which the stand is a pair of feet which are positioned together to form a continuous bottom supporting surface and a single heel portion, wherein the single heel portion includes a recess for selectively receiving the second end of the toothbrush handle therein.

A fifth object is to provide a toothbrush assembly, in which a base is connected to the bottom side of the foot stand for providing additional stability to the foot stand.

A sixth object is to provide a toothbrush assembly, in which the base includes a recess extending therethrough and in alignment with the recess in the foot stand for additionally receiving the second end of the toothbrush handle therein, for providing additional stability to the foot stand and brush handle.

A seventh object is to provide a toothbrush assembly, in which the handle is in the shape of a torso of an animate object conforming with the shape of the foot stand, wherein the first and second end of the handle further includes expanded vertical and horizontal members having the shape of arms and legs extending therefrom.

An eight object is to provide a toothbrush assembly, in which a cover is provided in the shape of a head conforming with the shape of the handle and foot stand, for selectively covering the bristle head.

A ninth object is to provide a toothbrush assembly, that will improve motivational aspects, to encourage a child to easily assemble the parts of the toothbrush assembly together when not in use, so as to promote a superior way to achieve desirable habits associated with good oral hygiene.

A tenth object is to provide a toothbrush assembly that will enforce a child who likes cartoon characters to utilize the hygienic values incorporated into the invention, instead of the stark and unattractive existing toothbrush systems.

An eleventh object is to provide a toothbrush assembly that is simple and easy to use.

A twelfth object is to provide a toothbrush assembly that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the append claims.

BRIEF DESCRIPTION OF THE DRAWING FIGURES

Various other objects, features and attendant advantages of the present invention will become more fully appreciated as the same becomes better understood when considered in conjunction with the accompanying drawings, wherein.

DETAILED DESCRIPTION OF THE PREFERRED EMBODIMENTS

Figure 1:
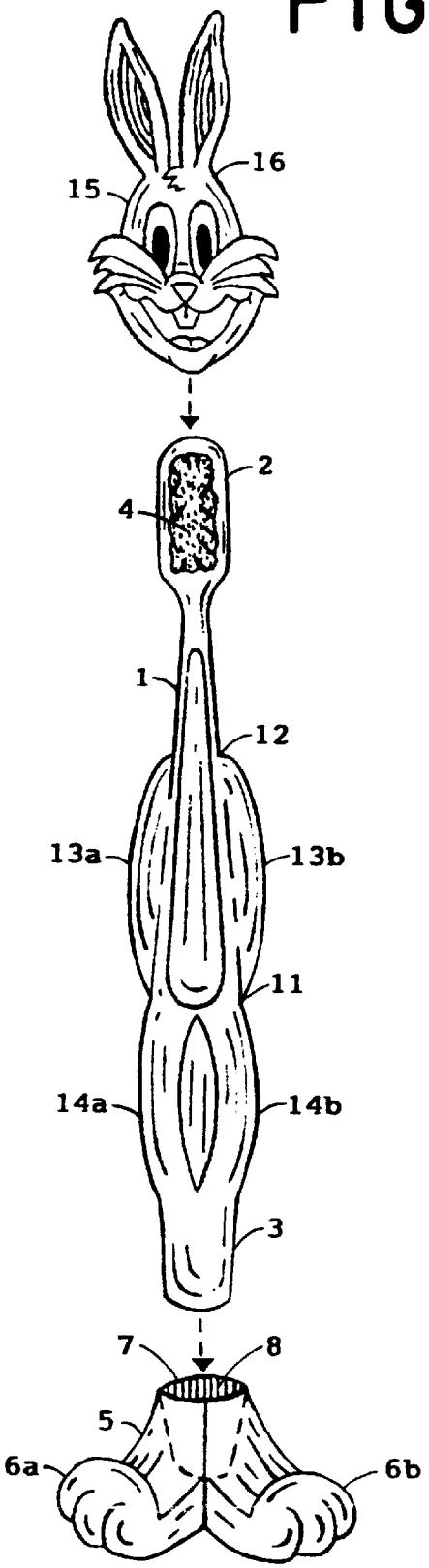
FIG. 1 is a front exploded perspective view of the toothbrush assembly according to the present invention.
Figure 2:
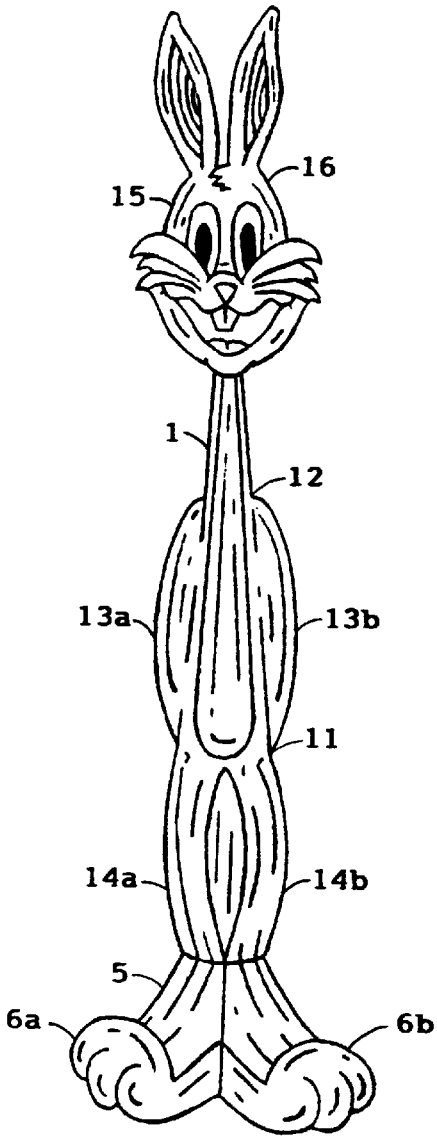
FIG. 2 is a front perspective view of the toothbrush assembly in FIG. 1 assembled together.

With regard to FIGS. 1 and 2, the embodiment of the invention drawn shows an elongated toothbrush handle 1 having a first end 2 a second end 3 and a first and second side. A bristle head 4 is positioned on the first side of first end 2. A stand 5 is in the shape of first and second feet 6*a* and 6*b*. Each first and second feet 6*a* and 6*b*, are elongated to define a toe end and together a common heel end. First and second feet 6*a* and 6*b* are joined together and positioned together to form a continuous bottom supporting surface. The heel end of each first and second feet 6*a* and 6*b*, is positioned together to form a single heel portion 7. Single heel portion 7 includes a recess 8 extending through a top side thereof and towards a sole thereof for selectively receiving second end 3 of handle 1 therein, thereby retaining handle 1 in a vertical position when stand 5 is placed on a horizontal surface. First and second feet 6*a* and 6*b* each include a side surface, the side surfaces intersect one another in a common plane. The toe end of each first and second feet 6*a* and 6*b* extends in the same direction as bristle head 4. The heel end of each first and second feet 6*a* and 6*b* is substantially flush with the second side of handle 1.

Figure 3:
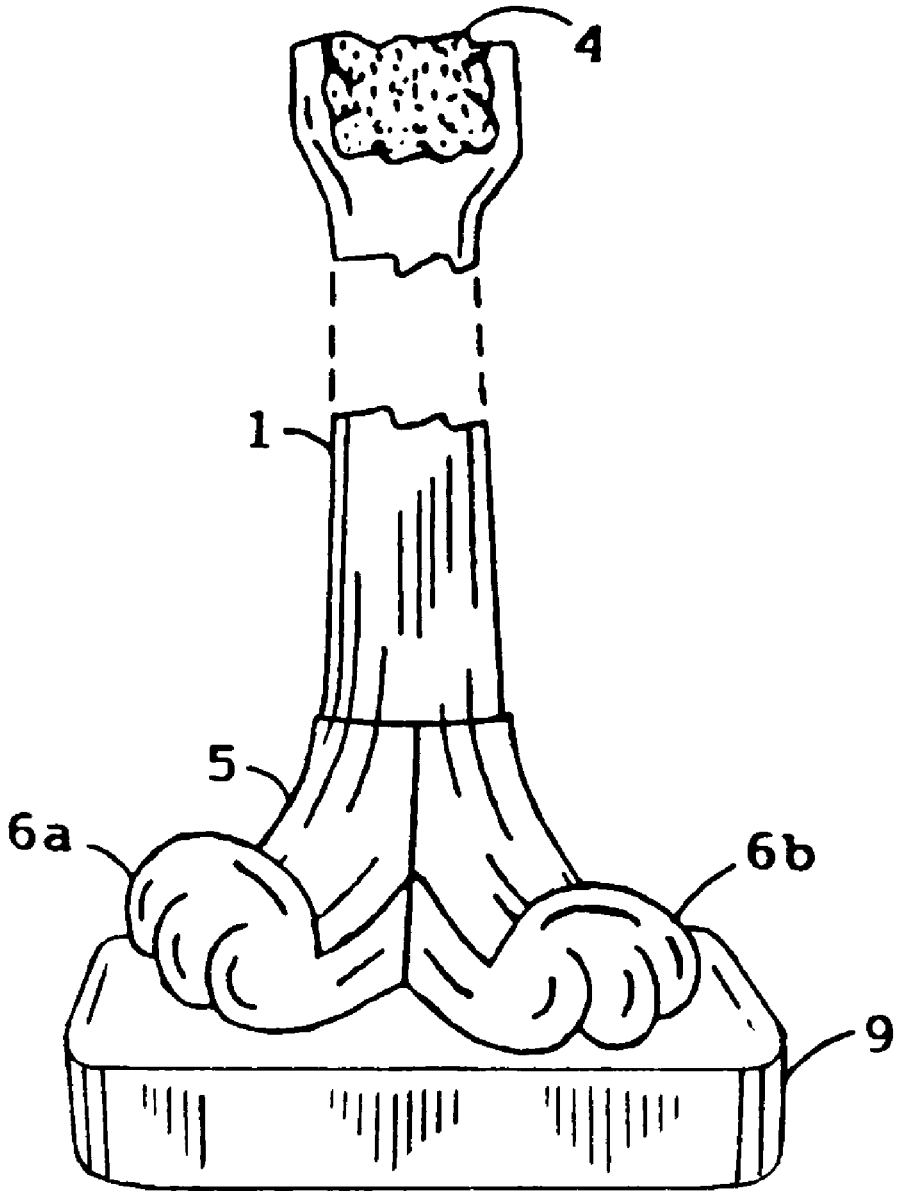
FIG. 3 is a front perspective view similar to FIG. 2 broken away, showing a base for the stand.
Figure 4:
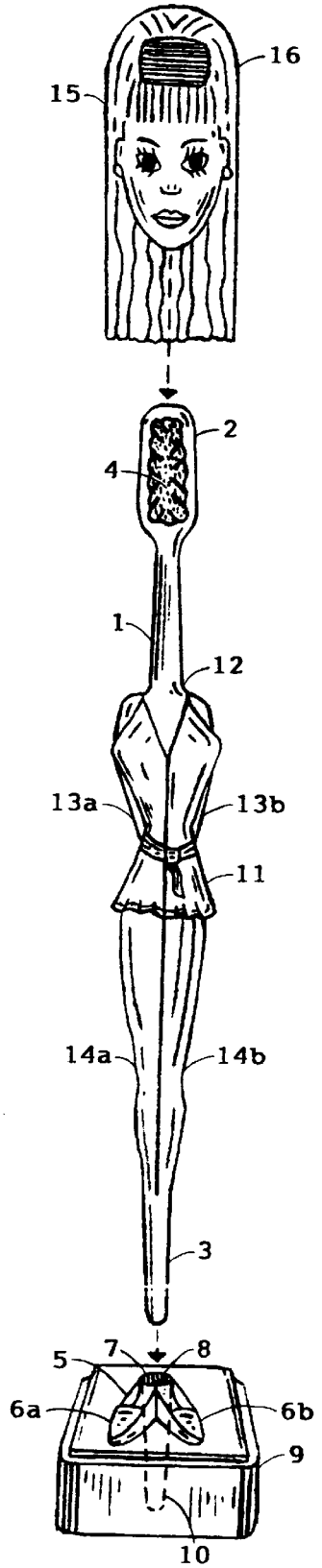
FIG. 4 is a front exploded perspective view of the toothbrush assembly according to the present invention showing a base for the stand.
Figure 5:
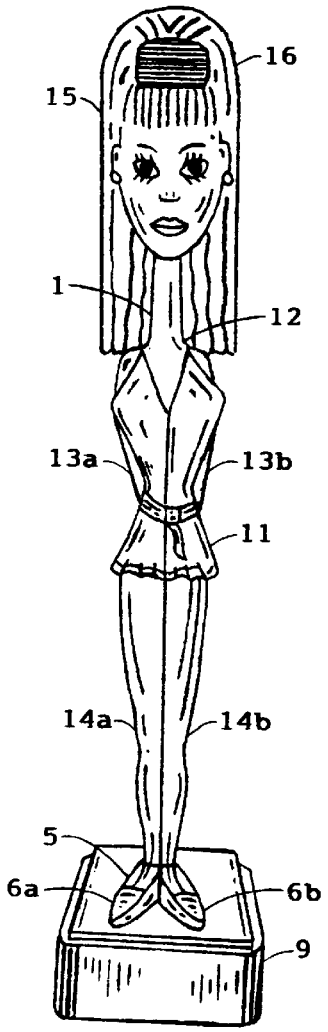
FIG. 5 is a front perspective view of the toothbrush assembly in FIG. 4 assembled together.

If desired, a base 9 could be connected to a bottom side of stand 5 as shown in FIG. 3. In FIGS. 4 and 5, base 9 includes a recess 10 extending therethrough and in alignment with recess 8 in stand 5 for additionally receiving second end 3 of handle 1 therein, to provide additional stability to handle 1 and stand 5.

In preferred form, handle 1 is in the shape of a torso 11 of animate object 12, conforming to the shape of first and second feet 6*a* and 6*b*, wherein first end 2 of handle 1 further includes expanded vertical and horizontal members 13*a* and 13*b*, having the shape of arms extending therefrom matching torso 11 of animate object 12. The second end 3 of handle 1 further includes expanded vertical and horizontal members 14*a* and 14*b*, having the shape of legs matching torso 11 of animate object 12.

A cover 16 is provided having the shape of a head 15, conforming to the shape of handle 1 of torso 11 of animate object 12, and feet 6*a* and 6*b* for selectively covering bristle head 4.

While certain novel features of this invention have been shown and described are pointed out in the annexed claims, it is not intended to be limited to the details above, since it will be understood various omissions, modifications, substitutions and changes in the forms and details of the device illustrated and in its operation can be made by those skilled in the art without departing in any way from the sprit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A toothbrush assembly comprising:

a) an elongated handle including:

i) a first end;

ii) a second end;

iii) a first and second side; and iv) a bristle head being positioned on said first end and extending from said first side. and b) a stand in the shape of first and second feet, each of said first and second feet being elongated to define a toe end and together a common heel end, said first and second feet being joined together and positioned together to form a continuous bottom supporting surface, said heel end of each of said first and second feet being positioned together to form a single heel portion, said single heel portion including a recess extending through a top side thereof and towards a sole thereof for selectively receiving said second end of said handle therein, thereby retaining said handle in a vertical position when said stand is placed on a horizontal surface, said first and second feet each including a side surface, said side surfaces intersecting one another in a common plane.

2. The toothbrush assembly as claimed in claim 1, further comprising a base connected to a bottom side of said stand.

3. The toothbrush assembly as claimed in claim 2, wherein said base includes a recess extending therethrough and in alignment with said recess in said stand for additionally receiving said second end of said handle therein.

4. The toothbrush assembly as claimed in claim 1, wherein said toe end of said first and second feet extends in the same direction as said bristle head and said heel end of said first and second feet is substantially flush with said second side of said handle.

5. The toothbrush assembly as claimed in claim 1, wherein said toe end of said first and second feet are at an acute angle to one another.

6. The toothbrush assembly as claimed in claim 1, wherein said handle is in the shape of a torso of an animate object conforming with said shape of said first and second feet, said first end of said handle further including expanded vertical and horizontal members having the shape of arms extending therefrom.

7. The toothbrush assembly as claimed in claim 6, wherein said second end of said handle further includes expanded vertical and horizontal members having the shape of legs matching said torso.

8. The toothbrush assembly as claimed in claim 7, further comprising a cover having the shape of a head conforming with said shape of said handle and said first and second feet for selectively covering said bristle head.

9. The toothbrush assembly as claimed in claim 8, wherein said animate object is a standing rabbit figure.

10. A toothbrush assembly comprising:

a) an elongated handle including:

i) a first end;

ii) a second end;

iii) a first and second side; and iv) a bristle head being positioned on said first end and extending from said first side. and b) a stand in the shape of first and second feet and including a base on which said first and second feet are mounted, said first and second feet and said base each including a recess for receiving said second end of said handle therein, thereby retaining said handle in a vertical position when said stand and said base are placed on a horizontal surface.

11. The toothbrush assembly as claimed in claim 10, wherein said handle is in the shape of a torso of an animate object conforming with said shape of said first and second feet, said first end of said handle further including expanded vertical and horizontal members having the shape of arms extending therefrom.

12. The toothbrush assembly as claimed in claim 11, wherein said second end of said handle further includes expanded vertical and horizontal members having the shape of legs matching said torso.

13. The toothbrush assembly as claimed in claim 12, further comprising a cover having the shape of a head conforming with said shape of said handle and said first and second feet for selectively covering said bristle head.

14. The toothbrush assembly as claimed in claim 13, wherein said animate object is a standing girl figure.

* * * * *